United States Patent [19]

Mizutani

[11] 4,038,842

[45] Aug. 2, 1977

[54] APPARATUS OF CONTINUOUSLY TREATING WIDE KNITTED FABRIC

[75] Inventor: Hiroshi Mizutani, Mie, Japan

[73] Assignee: Nippon Dyeing Machine Mfg. Co., Ltd., Japan

[21] Appl. No.: 699,646

[22] Filed: June 24, 1976

[30] Foreign Application Priority Data

July 9, 1975 Japan ..... 50-84106

[51] Int. Cl.[2] ..... D06B 3/20

[52] U.S. Cl. ..... 68/177; 68/175; 68/184; 68/207

[58] Field of Search ..... 68/175, 177, 178, 179, 68/183, 184, 44, 62, 158, 207

[56] References Cited

U.S. PATENT DOCUMENTS

| | | | |
|---|---|---|---|
| 1,206,420 | 11/1916 | Denman | 68/175 X |
| 3,553,983 | 1/1971 | Korsch | 68/177 |
| 3,978,696 | 9/1976 | Ito et al. | 68/184 X |

FOREIGN PATENT DOCUMENTS

| | | | |
|---|---|---|---|
| 467,128 | 8/1950 | Canada | 68/158 |
| 2,066 | 1/1972 | Japan | 68/178 |
| 23,720 | 7/1972 | Japan | 68/207 |

*Primary Examiner*—Philip R. Coe

*Attorney, Agent, or Firm*—Martin A. Farber

[57] ABSTRACT

An endless net conveyor is suspended from a drive wheel which is mounted at an upper part of the apparatus, hanging into a treating bath, and a metal gauze member is extended along the outer periphery of the net conveyor thereby forming a U-shaped path between the net conveyor and the metal gauze member. One upper opening part of the U-shaped path constitutes an introduction side for insertion of the fabric to be treated, and the other upper opening part of the U-shaped path constitutes an exit side for the treated fabric, both upper openings serving to convey the fabric continuously therethrough during treatment. Injection pipes are provided in the bath on both exterior sides of the U-shaped path, namely on an inside side and on an outside side of the path, the injection ports of the pipes being alternatingly directed toward the path. A circulation pump disposed outside of the bath circulates the treatment liquid, the suction side of the circulation pump being connected in communication with the treating bath inwardly of the net conveyor. The blowing side of the circulation pump is connected to the upper part of the U-shaped path and to the injection pipes on both the inside side and the outside side of the path, respectively, via injection-flow control valves.

12 Claims, 1 Drawing Figure

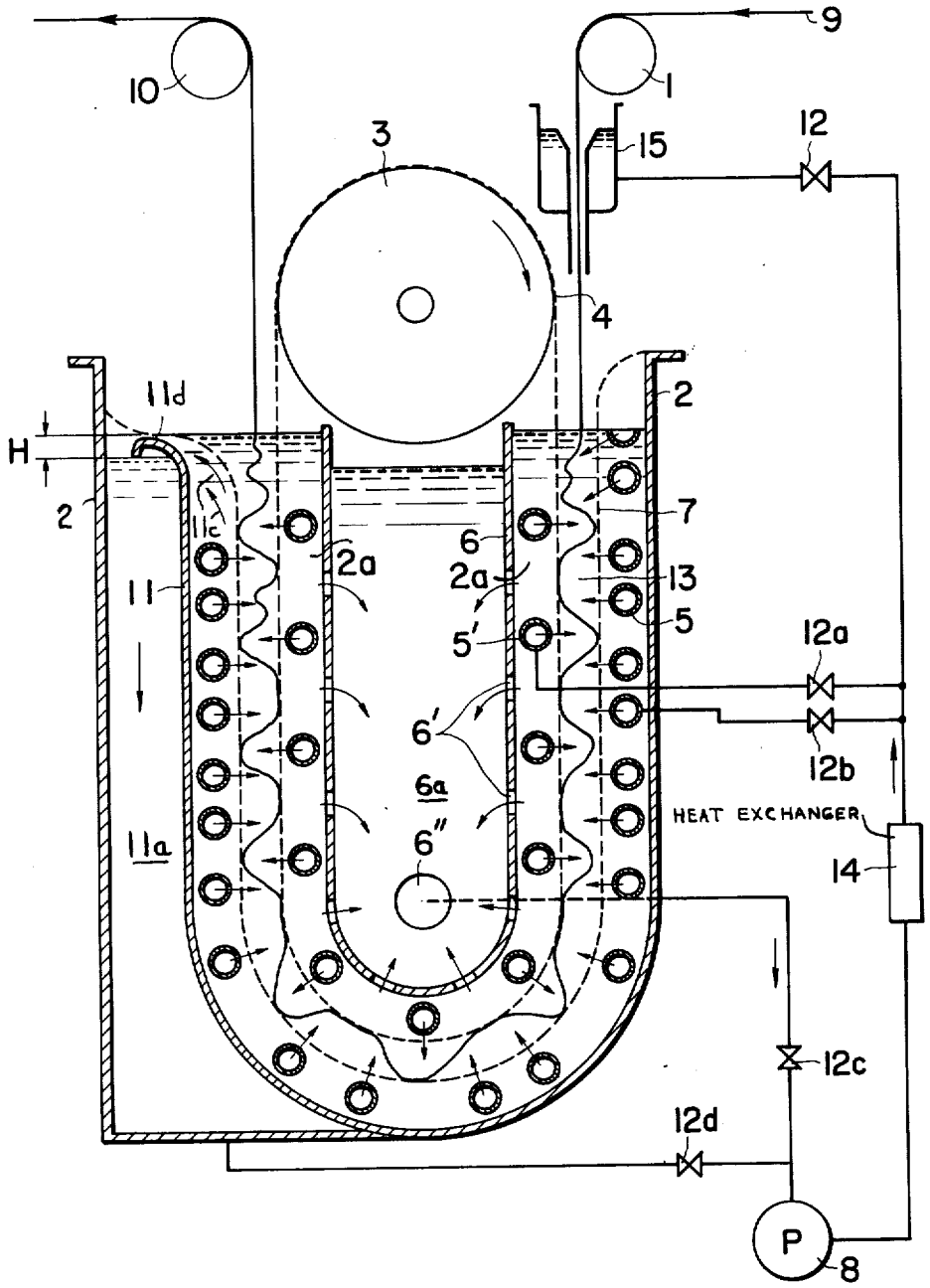
9
10
1
3
15
12
4
11d
2
H
2
7
11c
6
2a
2a
13
11
5
5'
12a
6'
12b
6a
HEAT EXCHANGER
11a
6''
14
12c
12d
P
8

APPARATUS OF CONTINUOUSLY TREATING WIDE KNITTED FABRIC

The present invention relates to an apparatus for treating fabrics of the type in which the fluid is injected toward both surfaces of the fabric which is carried along a net conveyor provided in the treating liquid.

A method has already been proposed by which a plurality of net conveyors are disposed in parallel in a vertical direction, and a fluid or a gas is injected from both sides of the fabric, passing through the clearances or spaces of the net conveyors in the device for treating the fabric (Japanese Laid-open patent application No. 15501/72).

It is an object of the present invention to provide an apparatus constituting an improvement over the above-mentioned device in which the net conveyors are vertically disposed.

In accordance with the present invention, an endless net conveyor is suspended from a drive wheel which is installed at an upper part of the apparatus, hanging into a treating bath, and a metal gauze member is expanded along the outer periphery of the net conveyor thereby forming a U-shaped path between the net conveyor and the metal gauze member. One upper opening part of the U-shaped path constitutes and serves as an introduction side for insertion of the fabric to be treated, and the other upper opening part of the U-shaped path constitutes a removal or exit side for the treated fabric, both upper openings serving to convey the the fabric continuously therethrough during treatment. Injection pipes are provided in the bath on both exterior sides of, yet exterior to the path, namely on an inside side and on an outside side of the path, the injection ports of the pipes being alternatingly directed toward the path. A circulation pump disposed outside of the bath circulates the treatment liquid, the suction side of the circulation pump being connected interior to the net conveyor. The blowing side of the circulation pump is connected to the upper part of the U-shaped path and to the injection pipes on both the inside side and the outside side of the path, respectively, via injection-flow control valves.

With the above and other objects in view, the present invention will become more clearly understood from the following detailed description of a preferred embodiment of the invention in connection with the accompaning drawing, of which the only FIGURE is an elevational cross-sectional view of an embodiment of an apparatus for continously treating wide knitted fabrics in accordance with the invention.

Referring now to the drawing, an endless net conveyor 4 is suspended from a drive wheel 3 which is rotatably mounted by any conventional drive (not shown) above the treating bath 2*a*, the latter being defined by walls (2, 6). The net conveyor 4 hangs into the bath 2*a* from the drive wheel 3. A U-shaped inner wall 6 of the treatment bath is provided under the drive wheel 3 spaced inwardly relative to the hanging net conveyor 4. A metal gauze 7 having upper ends, which are secured to the outer walls 2 of the bath or in any other suitable manner, is spread out, extended or expanded following along the outerside periphery of the net conveyor 4 spaced parallel therefrom maintaining a substantially uniform clearance to thereby form a U-shaped path 13 between the net conveyor 4 and the metallic gauze 7.

Injection pipes 5 are diposed in the bath exterior to the U-shaped path 13 on an outside side thereof between the net conveyor 4 and the outer portion wall 2. Injection pipes 5' are disposed in the bath 2*a* exterior to the U-shaped path 13 on an inside side relative thereto between the net conveyor 4 and the inner wall 6. Both the injections pipes 5 and 5' are disposed within the inner and outer walls of the treating bath. The pipes 5 and 5' are provided with injection ports which are directed substantially perpendicularly toward the U-shaped path 13 in the directions respectively indicated by the arrows on the pipes 5 and 5'. Here, the pipes 5 and 5' are alternatingly disposed. That is, a pair of the outermost pipes 5 are disposed between the adjacent innermost pipes 5', a pair of the ports of two pipes 5, respectively, being directed toward the treatment path 13 between the adjacent pipes 5'. The pipes 5 on the outside side of the path 13 have a stronger injection force that that of the pipes 5' on the inside side. Further, those injection ports of the uppermost pipes 5 on the outside side which are adjacent the introduction opening upper portion of the bath, open and are directed downwardly and inclined with respect to the path 13 in order to aid the introduction of the fabric 9 into the U-shaped path.

The inner wall 6 is formed with a plurality of suction ports 6' through which the treatment liquid is removed by action of a circulation pump 8, the suction side of which pump is connected to communicate with an exhaust opening 6'' in the central interior chamber 6*a* defined by the inner wall, the exhaust opening 6'' being formed in the side wall portion in the inner wall 6 and the bottom in the bath 2*a*. The blowing (pressurized) side of the circulation pump 8 is connected to communicate with an overflow-type introducing device 15 which overflows onto the fabric 9 passing therethrough to help carry it into the path 13, the device 15 being mounted above the introduction (insertion) side of the treatment path 13. The blowing side of the pump 8 also is connected to communicate with all the injection pipes 5 and 5' (only one illustrative connection for each set —5 and 5'— of the pipes being shown in the drawing for ease of illustration) which are respectively provided on the outside side and inside side of the treatment path 13. Flow control valves 12, 12*a*, 12*b*, 12*c* and 12*d* are disposed in the flow circuit for control purposes.

An introduction roller 1 is mounted above the insertion side of the treatment path, and a removal roller 10 which is rotatably driven by any conventional drive (not shown) is mounted above the exit side of the treatment path 13, on which rollers the fabric 9 passes. A heat exchanger 14 is disposed in the flow circuit downstream of the blowing side of the circulation pump (P) 8.

If a partition plate 11 is provided in the treatment bath 2*a* e.g. adjacent the outlet leg of the U-shaped path, the treating liquid which is injected, upon flowing into the chamber 11*a* as indicated by the flow arrows 11*c* e.g. over the edge 11*d* of the partition 11 formed lower than the adjacent top edge of the inner wall 6, develops a head H on one side (here namely the outlet leg side) of the U-shaped path due to the circulation by the pump 8; and the fabric 9 is conveyed more smoothly enabling and enhancing the performance of a continuous treatment. The liquid in the chamber 11*a* is in outlet communication with the suction side of the pump 8 via control flow valve 12*d*.

In operation of the above-described apparatus, the fabric 9 is introduced in a waved shape into the U-shaped path 13, together with the treating liquid, by way of the introduction roller 1, the speed of rotation of which is set by any conventional drive means (not shown) to be equal to, or higher than, the speed of the net conveyor 4, through and also by means of the introduction device 15. The fabric 9 is conveyed by the transfer action of the net conveyor 4 and by the flow of the treating liquid. While passing through the U-shaped path, the fabric is continuously treated by the treating liquid which is injected from both sides of the treatment path 13. The treating liquid is always injected stronger from the outside side by the pipes 5 than from the inside side by the pipes 5'; and the inside side of the inner wall 6, which is exterior to and on the inside side of the path, is in communication with the suction side of the circulation pump 8 in order to cause the treatment liquid to flow overall in an inward direction. Therefore the fabric 9 is brought more in contact with the net conveyor 4 than it is in contact with the gauze 7, and the fabric 9 is thus conveyed through the U-shaped path 13 by and along with the net conveyor 4, which in turn is driven by the wheel 3, without being affected by the buoyancy and the disturbed current.

According to the present invention, a uniform U-shaped path is formed along substantially the entire circumference or periphery by means of a single net conveyor 4 and a metal gauze expanded on the outside thereof, enabling the smooth, practical and efficient carrying of the fabric.

While I have disclosed one embodiment of the present invention, it is to be understood that this embodiment is given by example only and not in a limiting sense.

I claim:

1. An apparatus for continuously treating knitted fabric, comprising walls defining a treatment bath therein, said walls including at least an inner wall and an outer wall, a drive wheel rotatably mounted above said treating bath, an endless net conveyor operatively suspended about said drive wheel and having a portion thereof hanging into said treating bath, the portion of said net conveyor in said treating bath being spaced from said walls, a metallic gauze member stationarily mounted in said treating bath spaced from said walls, said gauze member extending about said net conveyor and spaced therefrom so as to define a U-shaped path between said net conveyor and said gauze member, said U-shaped path having an upper introduction opening on one side of the U-shaped path and an upper exit opening on the other side of the U-shape path, means for continuously passing a fabric into said introduction opening and for continuously removing said fabric from said exit opening, respectively, so that the fabric being treated is continuously conveyed through said treating bath, a plurality of inner injection pipes having first ports, respectively, disposed in said bath exterior to said path between said net conveyor and said inner of said walls, and a plurality of outer injection pipes having second ports, respectively, disposed in said bath exterior to said path between said gauze member and said outer of said walls, said first and second ports being directed alternatingly toward said path, circulation pump means disposed exterior to said treating bath for circulating a treating liquid, and including a suction side operatively communicating with said treating bath from a portion exterior to said path inwardly thereof, and including a blowing side operatively communicating with an upper part of said U-shaped path and communicating with said inner and outer injection pipes, respectively, injection flow control valves operatively connected in communication with said inner and outer injection pipes, respectively, and said circulation pump.

2. The apparatus, as set forth in claim 1, wherein two of said second ports of two of said outer injection pipes, respectively, are directed between two adjacent of said first ports of two adjacent of said inner injection pipes, respectively, facing in a direction towards each other, alternately.

3. The apparatus, as set forth in claim 2, wherein said plurality of inner injection pipes are spaced substantially uniformly along said U-shaped path, said two of said second ports of said two of said outer injection pipes, respectively, are disposed between every said two adjacent of said first ports, respectively.

4. The apparatus, as set forth in claim 1, wherein said outer injection pipes include injection pipes disposed at an upper part of said treating bath adjacent said introduction opening and having injection ports inclined toward, and downwardly with respect to, said U-shaped path in an advancing direction of the fabric.

5. The apparatus, as set forth in claim 1, further comprising a partition plate disposed in said treating bath adjacent said other side of said treating bath and defining a chamber for developing a head of the treating liquid on the outlet side of said U-shaped path.

6. The apparatus, as set forth in claim 5, wherein said chamber communicates with said outlet side of said treating bath, and communicates with said suction side of said circulation pump means.

7. The apparatus, as set forth in claim 1, wherein said plurality of outer injection pipes constitutes means for injecting the treating liquid with a stronger force than that of said plurality of inner injection pipes, for pressing the fabric more against said net conveyor than against said metallic gauze member in further cooperation with the action of said circulation pump means, whereby the fabric pressed against said net conveyor is conveyed through said U-shaped path by said net conveyor operatively via said drive wheel.

8. The apparatus, as set forth in claim 1, wherein said means for passing a fabric into said introduction opening includes an overflow introduction means in communication with said blowing side of said circulation pump means through which the fabric passes for guiding the fabric into said introduction opening of said U-shaped path, said overflow introduction means is mounted above said introduction opening of said U-shaped path.

9. The apparatus, as set forth in claim 8, wherein further said means for passing a fabric into said introduction opening further includes introduction roller means rotatably mounted above said overflow introduction means on which roller means the fabric is disposed for introducing the fabric into said overflow introduction means and into said introduction opening of said U-shaped path.

10. The apparatus, as set forth in claim 9, wherein said introduction roller means drives the fabric at least at a speed whereby the fabric enters said U-shaped path in a waved shape.

11. The apparatus, as set forth in claim 1, wherein said metallic gauze member and said net conveyor each consists of a single member spaced uniformly apart to form said U-shaped path.

12. The apparatus, as set forth in claim 1, wherein said inner of said walls is U-shaped defining a central interior chamber and disposed under said drive wheel, said inner wall is formed with a plurality of suction ports communicating the treating bath with said central interior chamber, said interior chamber having a side wall formed with an exhaust opening at a bottom thereof connected in communication with said suction side of said circulation pump means.

* * * * *